US009776144B1

(12) United States Patent
Lu et al.

(10) Patent No.: US 9,776,144 B1
(45) Date of Patent: Oct. 3, 2017

(54) TOP-FILLING HUMIDIFIER

(71) Applicant: Zhongshan Titan Arts & Crafts Co., Ltd., Guangdong (CN)

(72) Inventors: Shao Quan Lu, Guangdong (CN); Yu Yang, Guangdong (CN); Lei Peng Zuo, Guangdong (CN); Xian An Wu, Guangdong (CN); Peng Fei Zuo, Guangdong (CN); Hai Feng Yan, Guangdong (CN); Mu Mian Wang, Guangdong (CN); Ze Hui Hu, Guangdong (CN)

(73) Assignee: ZHONGSHAN TITAN ARTS & CRAFTS CO., LTD., Guangdong (CN)

( * ) Notice: Subject to any disclaimer, the term of this patent is extended or adjusted under 35 U.S.C. 154(b) by 0 days.

(21) Appl. No.: 15/633,500

(22) Filed: Jun. 26, 2017

(30) Foreign Application Priority Data

Apr. 22, 2017 (CN) ..... 2017 2 0433588

(51) Int. Cl.
*B01F 3/04* (2006.01)
*F24F 3/14* (2006.01)

(52) U.S. Cl.
CPC ..... *B01F 3/0407* (2013.01); *F24F 3/14* (2013.01)

(58) Field of Classification Search
CPC .... B01F 3/04; B01F 3/04007; B01F 3/04021; B01F 3/0407; F24F 3/14
USPC ..... 261/78.2, 81, 72.1
See application file for complete search history.

(56) References Cited

FOREIGN PATENT DOCUMENTS

| | | | |
|---|---|---|---|
| CN | 103604187 A | | 2/2014 |
| JP | 54101508 A | * | 8/1979 |
| JP | 62138631 A | * | 6/1987 |
| JP | 3198431 | | 6/2015 |

* cited by examiner

*Primary Examiner* — Robert A Hopkins
(74) *Attorney, Agent, or Firm* — WPAT, P.C., Intellectual Property Attorneys; Anthony King

(57) ABSTRACT

An ultrasonic humidifier includes a tank having a water level and a floater having a tubular structure with a bottom rim and a top rim. The tubular structure has a frusto-conical shape and is vertically and co-axially disposed within the floater. The tubular structure having a widest diameter end disposed on the bottom rim and a narrower diameter end disposed at the top rim. This humidifier also has an air-supply arrangement that eliminates water damage to the fan during spillage.

20 Claims, 4 Drawing Sheets

TOP-FILLING HUMIDIFIER

FIELD OF THE DISCLOSURE

The field of the disclosure is water misting devices in general and humidifier specifically.

BACKGROUND OF THE DISCLOSURE

There is a need for an improved misting device that provides a finer misting for users to enjoy.

Despite numerous desirable properties in known humidifiers, these known humidifiers have several disadvantages. For example, known humidifiers or aromatic atomizers are designed to have a sealed tank having a screw cap located at the bottom of the tank. To add water, the user must remove the tank from the humidifier, invert it over, unscrew the cap, and then add water into the tank; and then after water is filled, screw the cap back on, invert it back and place the tank back on the humidifier. This is known as bottom-fill humidifier design. Conventional humidifiers use electronic ceramic vaporizer to produce high frequency (1.7 MHz) vibration to vaporize water.

Furthermore, other disadvantages of bottom-fill humidifier include that user cannot wash the tank. Germ and algae grows in the tank. The resulting mist would contain germs that cause respiratory issues. In addition, there is an inherent difficulty in filling water. Tank may slip off user's hand. Tank may fall on the floor and crack.

Furthermore, disadvantages of traditional air-supply channel are found when the fan directly supplies air into the mist-creating chamber. Some users would mistakenly pour water down the top opening where plume of mist comes out. Water would then short out the fan, and may even short out the electronics in the base. In addition, because the fan is directly connected to the mist-creating chamber, when a user tilts the humidifier at a steep angle, the pool of water above the ceramic vaporizing plate can flow onto the fan, shorting out the fan. If the fan no longer works, the plume of mist can travel back towards the fan and then to the other electronics in the base, shorting out other electronics.

There have been attempts to improve existing humidifier designs, For example, see prior art ultrasonic humidifier patents including CN 103604187A (this publication number having a priority date of Nov. 14, 2013) assigned to Shanghai Povos Electrical Company LTD [SHANN]; and JP 3194831 (this publication number having an application date of Apr. 21, 2015), both of which are herein incorporated by reference in their entireties All referenced patents, applications and literatures are incorporated herein by reference in their entireties. Furthermore, where a definition or use of a term in a reference, which is incorporated by reference herein, is inconsistent or contrary to the definition of that term provided herein, the definition of that term provided herein applies and the definition of that term in the reference does not apply. The embodiment may seek to satisfy one or more of the above-mentioned desires. Although the present embodiment may obviate one or more of the above-mentioned desires, it should be understood that some aspects of the embodiment might not necessarily obviate them.

Thus, there is still a need for a humidifier that provides one or more improvements over the prior art, for example, improved fine misting capability, ease of user filling water of the tank, decreased germ production, less opportunity of shorting out electronics during movement, tilting and filling with water.

BRIEF SUMMARY OF THE DISCLOSURE

In one aspect of the embodiment, an ultrasonic humidifier is disclosed that includes a tank having a water level. The ultrasonic humidifier includes a floater. The floater has a bottom rim and a top rim. A tubular structure is vertically disposed within the floater. The tubular structure has a widest diameter end disposed on the bottom rim and a narrower diameter end disposed at the top rim.

It is still further contemplated that this embodiment includes one or more of the following features and/or limitations; namely, the top rim being operatively positioned at a height below the water level, the height within a range of 6 mm to 8 mm;

the top rim being operatively positioned at a height below the water level, the height within a lower range between 5 mm to 10 mm and an upper range of between 15 mm to 20 mm;

a thickness of the floater is between a range of 15 mm to 20 mm;

a floater support disposed on an outer surface of the floater and wherein the top rim is disposed at a height below the water level, the height within a range of 5 mm to 20 mm;

a column disposed vertically and having a series of repeating through openings along its exterior walls;

an air diverting plate and a mist chamber, the air diverting plate operatively coupled to a fan, the fan supplies an amount of air into the mist chamber through the air diverting plate toward a top surface of the water level; wherein the fan is disposed in a chamber that is not directly connected to the column and the mist chamber;

a fan operatively coupled to an air vent, the air vent is disposed pointing toward an inner wall of the tank and outside of a wall of the air supply channel to isolate water spillage from contacting electrical and mechanical portions of the fan during accidental tipping of the tank;

the tubular structure includes a slanted directional frusto-conical shape with respect to a centrally located vertical axis of the tubular structure; and the floater has a diameter of the bottom rim within a range of 7 mm to 10 mm and a diameter of the top rim within a range of 4 mm to 6 mm.

In another aspect of the embodiment, an ultrasonic humidifier is disclosed that includes a tank having a water level. The ultrasonic humidifier further includes a mist chamber. A fan operatively couples to the mist chamber disposed above the top surface of the water level. The fan blows air into the mist chamber toward a top surface of the water level. A floater is slidably disposed within a float support. The floater has a bottom rim and a top rim. An ultrasonic transducer disposed directly below the floater. A tubular structure is vertically disposed within the floater. The tubular structure has a widest diameter end disposed on the bottom rim and a narrower diameter end disposed at the top rim. In one example, the mist chamber diverts air of the humidifier and of the tubular structure. In another example, the top rim is operatively positioned a height below the water level of the humidifier, the height having a range between 5 mm and 20 mm.

It is still further contemplated that this embodiment includes one or more the following features and/or limitations; namely, a thickness of the floater is between a range of 15 mm to 20 mm;

the floater support is disposed on an outer surface of the floater and wherein the top rim is disposed at a height below the water level, the height being within a range of 5 mm to 20 mm;

a column disposed vertically and having a series of repeating through openings along its exterior walls;

an air diverting plate, and an intermediate chamber, the intermediate chamber receives the air from the air diverting plate from the fan before the mist chamber and is disposed above the top surface of the water level; wherein the intermediate chamber is an air supply channel that is disposed isolated from the mist chamber, the water level, and the column such that accidental tipping and spillage from the tank is prevented from contacting electrical and mechanical portions of the fan;

the tubular structure includes a slanted directional frustoconical shape with respect to a centrally located vertical axis of the tubular structure; and the floater has a diameter of the bottom rim with a range of 7 mm to 10 mm and a diameter of the top rim within a range of 4 mm to 6 mm.

In another aspect of the embodiment, an ultrasonic humidifier is disclosed including a tank having a water level. The ultrasonic humidifier includes a column disposed vertically and having a series of repeating through openings along its exterior walls of its body, a floater, the floater having a bottom rim and a top rim. A tubular structure vertically disposed within the floater. The tubular structure having a widest diameter end disposed on the bottom rim and a narrower diameter end disposed at the top rim. The column is operatively coupled with the floater and the column has a series of repeated through openings. The top rim of the floater operatively maintains a position at a height below the water level, the height within a lower range between 5 mm to 20 mm.

It is still further contemplated that this embodiment includes one or more the following features and/or limitations; namely, a thickness of the floater is between a range of 15 mm to 20 mm; and a fan operatively coupled to a mist chamber disposed above the top surface of the water level, the fan supplies air into the mist chamber toward a top surface of the water level.

In one example, the fan is disposed in an intermediate chamber having an air vent that is a height within a range of 5 to 10 mm above the mist chamber, the water level, and the column such that accidental tipping and water spillage from the tank is prevented from contacting electrical and mechanical portions of the fan.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 1:
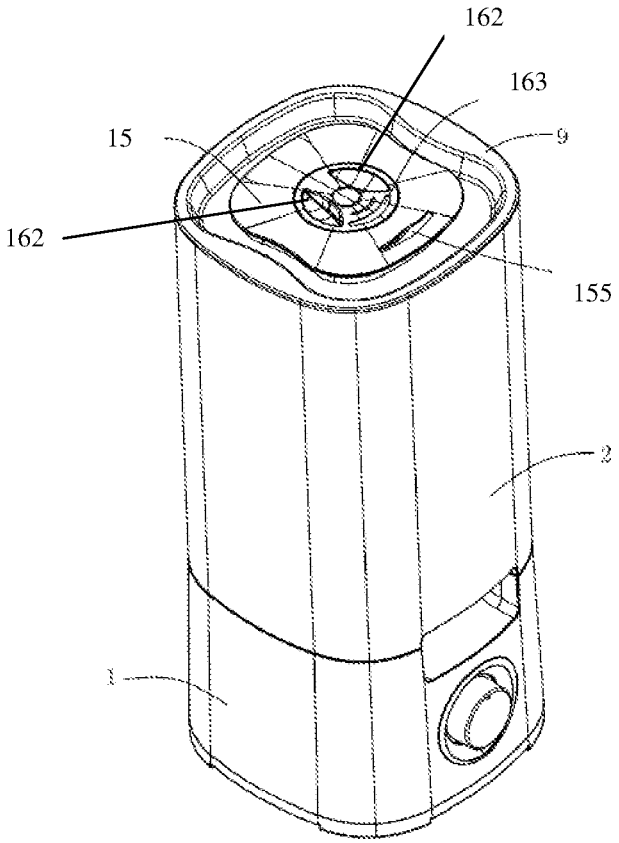
FIG. 1 is a front perspective view of a cover, a cover ring slot, a base and a tank of a humidifier according to an aspect of the embodiment.

For your reference, below is a collective listing of the parts of the humidifier that are used throughout the drawings:

1. Base
12. Base Bottom
13. Floater Support Inlet
2. Tank
21. Air Supply Channel
22. Air Supply Channel Output
23. Tank Supply Return Outer
24. Tank Supply Return Inner
25. Safety Float Support
26. Safety Float Stop
27. Safety Float
28. Safety Float Rod
3. Tank Cover
31. Tank Cover Bottom
32. Tank Lower Ring
33. Tank Inlet
34. Tank Return
351, 352, 353. Tank Lower Ring Rim Tabs
4. Ultrasonic Vaporizer (e.g., Ultrasonic Transducer)
5. Floater Support (e.g., Column)
51. Floater Support Attachment Ring
511. Floater Support Through Openings (e.g., Column Openings, Column Grid)
6. Floater
61. Tubular Structure
62. Top Rim
63. Bottom Rim
64. Floater Thickness
7. Fan
8. Power Source
9. Cover
91. Cover Right Side
92. Mist Chamber
93. Air Vent
95. Air Diverting Plate (first section)
94. Cover Outer Ring
95. Cover Middle Ring
96. Cover Center Ring
98. Air Diverting Plate (second section)
99. Turned Hollow Corner Structure
10. Floater Support Left Side
101. Floater Support Right Side
102. Floater Support Base
11. Safety Float Support

12. Bottom
13. Floater Support Supply Right Side
131. Floater Support Supply Left Side
14. Air Supply Channel Input
15. Cover Ring
151. Cover Ring Right Side
152. Cover Ring Left Side
153. Cover Ring Tabs
154. Cover Ring Top Opening
155. Cover Ring Slot
16. Cover Insert
162. Cover Insert Vent(s) (Vaporizer Air Vents Right and Left)
163. Cover Insert Slot
164. Cover Insert Bottom
165. Cover Insert Tabs
17. Opening to Cover Insert Vent(s)

DETAILED DESCRIPTION OF THE EMBODIMENTS

The embodiment and its various embodiments can now be better understood by turning to the following detailed description of the embodiments, which are presented as illustrated examples of the embodiment defined in the claims. It is expressly understood that the embodiment as defined by the claims may be broader than the illustrated embodiments described below.

Many alterations and modifications may be made by those having ordinary skill in the art without departing from the spirit and scope of the embodiment. Therefore, it must be understood that the illustrated embodiment has been set forth only for the purposes of example and that it should not be taken as limiting the embodiment as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

The words used in this specification to describe the embodiment and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Figure 2:
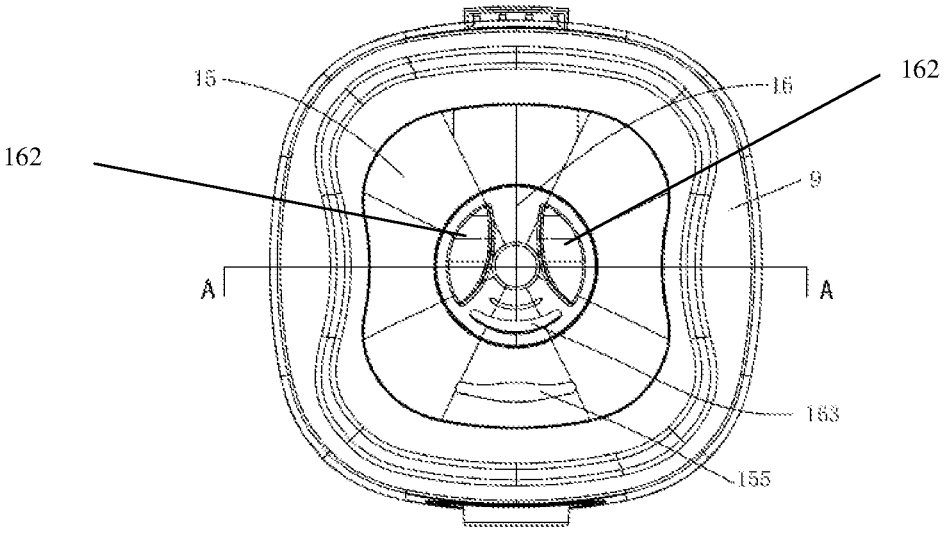
FIG. 2 is a top view of a cover ring, a cover insert, and a cover ring vent of the humidifier.
Figure 3:
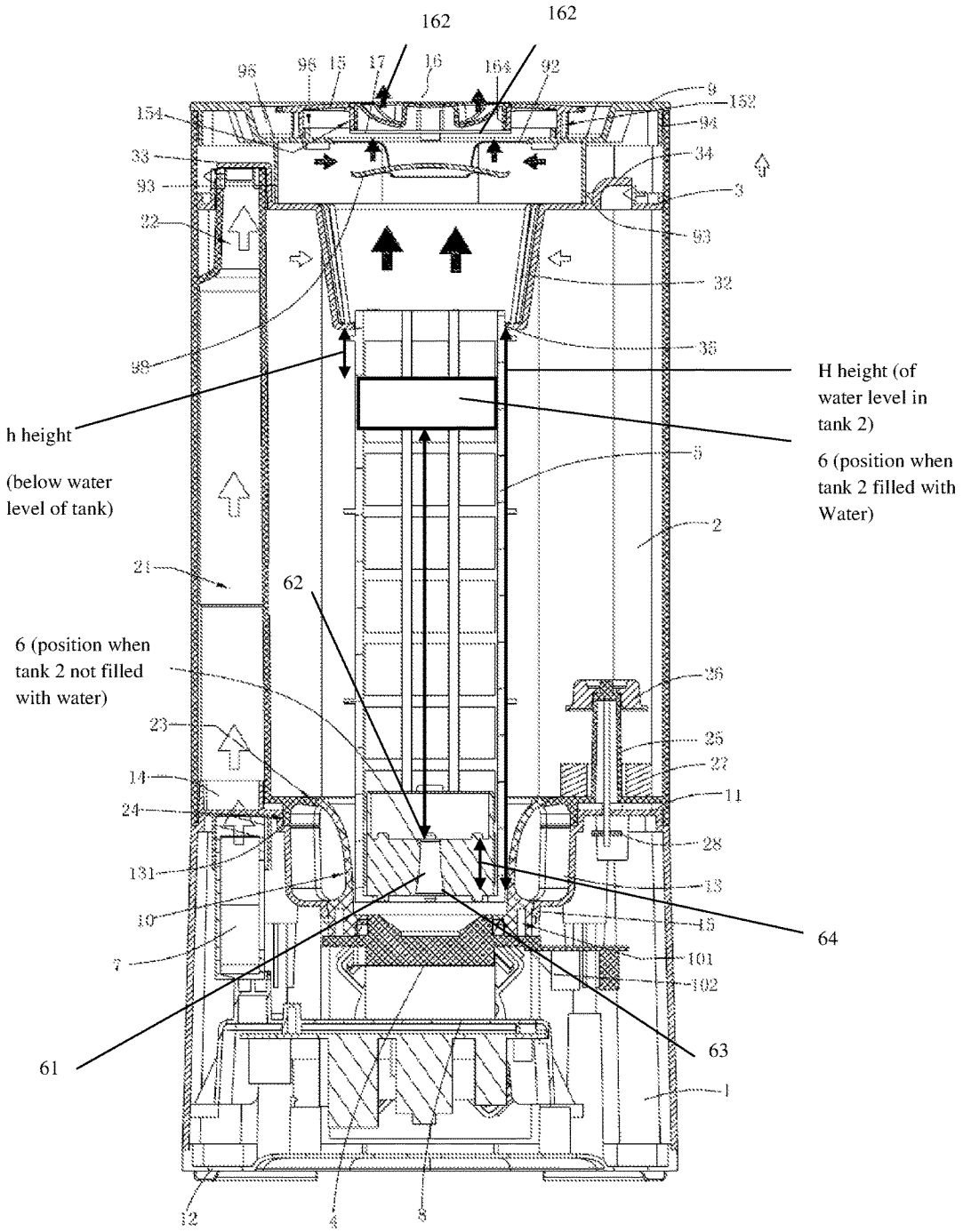
FIG. 3 is a cutaway side view along line A-A of FIG. 1, showing a floater, a floater support, ultrasonic vaporizer (e.g., ultrasonic transducer), air supply channel, and a fan of the humidifier of FIG. 1.
Figure 4:
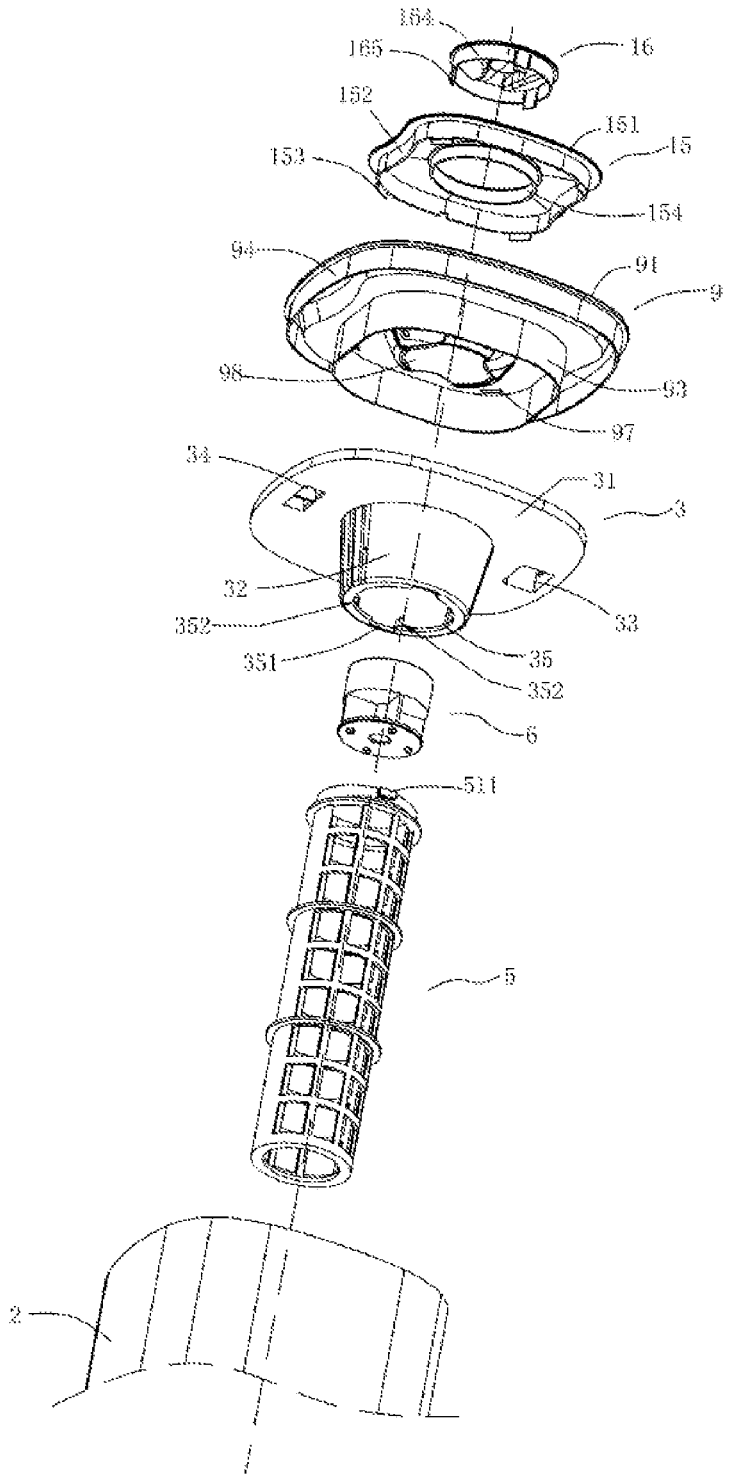
FIG. 4 is a partially exploded perspective side view of a cover ring, a cover insert, a floater, and a floater support of the humidifier according to an aspect of the embodiment of FIG. 1.
Figure 5:
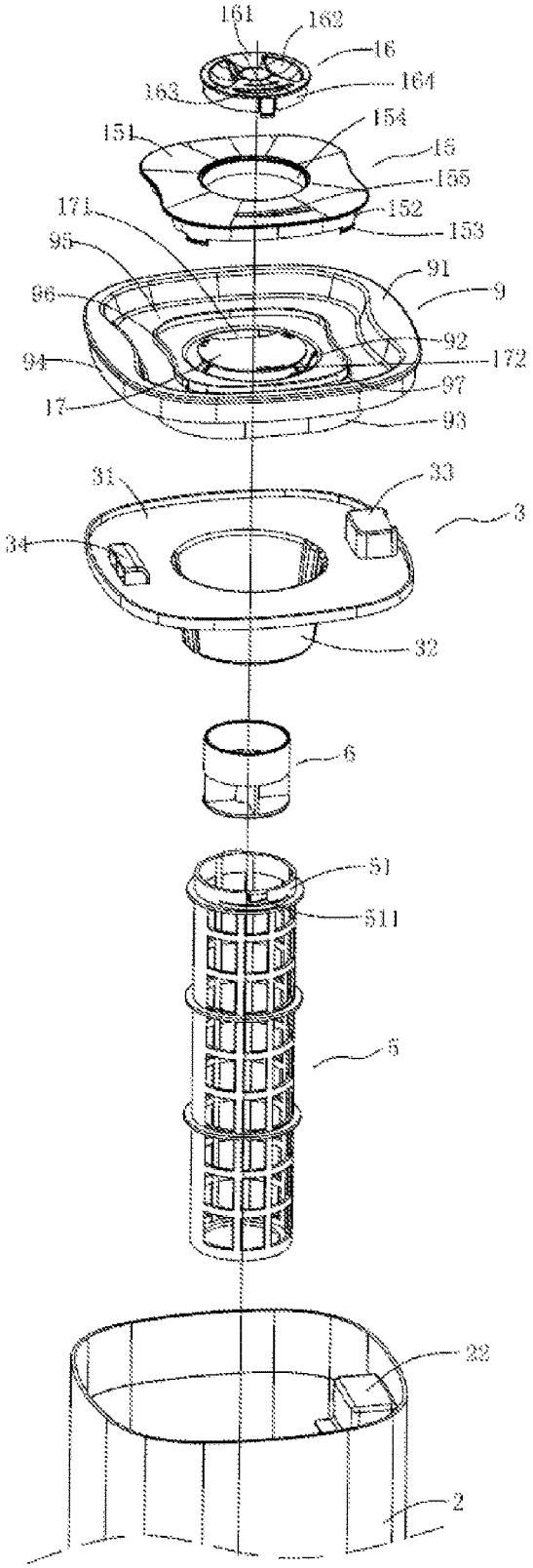
FIG. 5 is a partially exploded side perspective view of a cover insert, a cover ring, a cover, a tank cover, a floater, and a floater support of the humidifier according to an aspect of the embodiment of FIG. 1.

Referring now to FIGS. 1-5, the humidifier is disclosed below.

Before operating the humidifier, user can either pour water through cover insert vent(s) 162 of cover insert 16 to fill to a water level, or lift the tank cover 3 to pour water into the tank. In one or more embodiments, a full water level can be at a depth shown as H height in FIG. 3, e.g., H is measured from the ultrasonic vaporizer/transducer 4 to the top of floater support attachment ring 51. Advantageously, using this humidifier, the H level can be 176 mm +/−10 mm, with a 30 W ultrasonic vaporizer 4 and still produce optimal plume of mist. Because of this increased H level (as compared to many conventional humidifiers having a 30-40 mm depth of water level), tank 2 can be designed as a top-fill tank. As such, a top-fill tank may have a much wider top opening that allows ease of cleaning, e.g., to prevent build-up of fungus or other substances inside the humidifier.

Floater 6 can have a density of approximately 0.92 g/cm$^3$, which is slightly lighter than a density of water 1.0 g/cm$^3$. In one embodiment, floater 6 floats within the floater support 5, and a top surface which is flush with the top rim 62 stops at a height "h" below a water level. Height h may range from a preferred range of 6 mm to 8 mm and an alternative and/or a secondary range between 5 mm to 20 mm The floater 6 can come in various different shapes and be made of various materials. The core concept is to have a floater 6 centered directly above the ultrasonic transducer 4, and allow the floater 6 to move vertically by the force of buoyancy, yet always remain directly above the ultrasonic transducer 4. The floater 6 can use a preferred density, preferred center of gravity, or both, such that the top rim of the tubular structure 61 remains within height "h" below the water level. When this height "h" is too great, the plumes of mist produced are drastically reduced. As discussed elsewhere in the this specification, the tubular structure 61 having a gradually upwardly decreasing diameter produces optimal accumulation of ultrasonic wave, thereby producing a bigger and higher plumes of mist.

One key purpose of height "h" is to minimize a known "panting" effect in prior art devices where the size and density of the plumes of mist produced fluctuate. In prior art devices having a float, horizontal vibration caused the ultrasonic waves may cause the float to move such that the float's top surface cycles between being extended above the water level and being just below the water level. This causes the panting effect. By purposely keeping the top rim 62 constantly below the water level at a distance as discussed, the density and size of mist produced remain relatively constant.

In one or more embodiments, floater support 5 contains through holes 511 that supplies water from the tank 2 into the interior space of the floater support 5, thereby moving the floater 6 in a vertical direction along the floater support 5 by the buoyancy force. The floater 6 has a tubular structure 61 disposed within a center of the floater 6 that extends from a bottom rim 63 to a top rim 62. The tubular structure 61 may be frusto-conical shaped, e.g., frusto-conical shape with respect to a central located vertical axis of the tubular structure 61. The tubular structure 61 is coaxial with the floater 6. The floater 6 may have a diameter of the bottom rim 63 that is within a range of 7 mm to 10 mm and a diameter of the top rim 62 within a range of 4 mm to 6 mm. The floater 6 may have a thickness 64 within a range of 15 mm to 20 mm. In one specific embodiment, the thickness can be 17.4 mm. This thickness is measured from the top rim 62 to the bottom rim 63.

As discussed above, in some embodiments, the floater 6 has a top surface that is flush with the top rim 62. Along the outer ridges of the top surface is a rising wall that surrounds the top surface. This extension of wall above and beyond the top surface is optional.

In operation, plumes of mist appear from the water surface directly above top rim 62 as ultrasonic wave travels upwards through the tubular structure 61. The plumes of mist stays within the mist chamber 92 until moved by air movement. In one or more embodiments, the tubular structure 61 includes a slanted directional frusto-conical shape with respect to a centrally located vertical axis of the tubular structure 61. The fan 7 blows air through air supply channel 21 through air vent 93 and tank inlet 33. Air exiting tank inlet 33 flows over the air diverting plates 95, 98 into the mist chamber 92 and moves mist to outside the humidifier.

Because fan 7 does not directly connect to the floater support 5, the mist chamber 92, and through air vent 93, electrical shortage of the fan is minimized. In some embodiments, the air vent 93 is disposed pointing toward an inner wall of the tank 2 and outside on a wall of the air supply channel 21 facing away from the tank 2. In one example, a water isolation cavity is formed using a corner shaped opening, e.g., turned, hollow corner structure 99, connects the air vent 92 to the tank inlet 33. As such, the air vent 93 is isolated from a water level of the tank 2, the mist chamber 92, and the tubular structure 61, e.g., from a lower rim 63 through the top rim 62, sprays a stream of water and plumes of mist into the mist chamber 92.

In some embodiments, an intermediate chamber is formed by the air channel input 14, the air channel 21, the air channel output 22, the air vent 93, and the tank inlet 33. The contemplated intermediate chamber protects the fan 7 from, e.g., isolates, from water spillage of the tank 2 or spillage from the mist chamber 92.

Advantageously, by placing as discussed above the air vent 93 away from the tank 2, accidental tipping and water spillage from the tank 2 is prevented from contacting electrical and mechanical portions of the fan 7.

Advantageously, floater 6 can have a lower center of gravity so that its top surface can be immersed in water below the water level. In one embodiment, the top surface of the float to the water level is contemplated to be 6-8 mm Advantageously, tests show that vaporizing effect is optimal when this water level is 6-8 mm. In other embodiments, height "h" can be 5-10 mm Yet in other embodiments, height "h" can be 5-15 mm Advantageously, the tubular structure 61 within the floater 6 accumulates the ultrasonic waves that were originally produced by the ultrasonic transducer 4 and spread out in the tank 2. The waves add on to one another within the tubular structure 61.

Advantageously, the cone-shaped tubular structure 61 may be formed at a tilted cone angle to increase a level of supercharging of misting.

Advantageously, column 5 and the floater 6 are co-axial, thereby keeping the floater 6 in a centering position.

Advantageously, the wall of the column 5 is shown to be a grid, or have through openings 511. These column openings allow the water to enter and exit the column 5. As a result, when the water level is low, as a plume of mist is created right above the top surface of the float 6, the plumes of mist can easily flow out through the wall of the column 5. Less preferable is to not have these through holes, which will cause the plumes of mist to only flow through the top of the column 5. In this way, the plumes of mist are more likely to be undesirably trapped within the column 5.

In yet other embodiments, the wall of the column 5 can optionally be made of a solid wall. In some embodiments, if the wall is solid or has through openings does not affect how the horizontal waves travels and accumulates in the channel of the floater 6.

Advantageously, prior art requires an H height, above the ultrasonic device, of 30-40 mm. In contrast, in the instant case, the humidifier can allow an H height above the ultrasonic device of 176 mm+/−10 mm Thus, specific embodiments and applications of the humidifier have been disclosed. It should be apparent, however, to those skilled in the art that many more modifications besides those already described are possible without departing from the disclosed concepts herein. The embodiment, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiment. In addition, where the specification and claims refer to at least one of something selected from the group consisting of A, B, C . . . and N, the text should be interpreted as requiring only one element from the group, not A plus N, or B plus N, etc.

The invention claimed is:

1. A ultrasonic humidifier including a tank having a water level, the ultrasonic humidifier comprising:

a floater, the floater having a bottom rim and a top rim; and a tubular structure vertically disposed within the floater, the tubular structure having a widest diameter end disposed on the bottom rim and a narrower diameter end disposed at the top rim.

2. The humidifier of claim 1, wherein the top rim being operatively positioned at a height below the water level, the height within a range of 6 mm to 8 mm.

3. The humidifier of claim 1, wherein the top rim being operatively positioned at a height below the water level, the height within a lower range of 5 mm to an upper range 20 mm.

4. The humidifier of claim 1, wherein a thickness of the floater is between a range of 15 mm to 20 mm.

5. The humidifier of claim 1, comprising a floater support disposed on an outer surface of the floater and wherein the top rim is disposed at a height below the water level, the height within a range of 5 mm to 20 mm.

6. The humidifier of claim 1, comprising a column disposed vertically within the tank and is coaxial with the tubular structure, the column having a series of repeating through openings along its exterior walls.

7. The humidifier of claim 2, comprising an air diverting plate and a mist chamber, the air diverting plate is operatively coupled to a fan; the fan supplies an amount of air into the mist chamber through the air diverting plate toward a top surface of the water level; wherein the fan is disposed in a chamber that is not directly connected to the column and the mist chamber.

8. The humidifier of claim 1, comprising a fan operatively coupled to an air vent, the air vent is disposed pointing toward an inner wall of the tank and outside of a wall of an air supply channel to isolate a water spillage from contacting an electrical and mechanical portions of the fan during an accidental tipping of the tank.

9. The humidifier of claim 1, wherein the tubular structure includes a slanted directional frusto-conical shape with respect to a centrally located vertical axis of the tubular structure.

10. The humidifier of claim 1, wherein the floater has a diameter of the bottom rim within a range of 7 mm to 10 mm and a diameter of the top rim within a range of 4 mm to 6 mm.

11. A ultrasonic humidifier including a tank having a water level, the ultrasonic humidifier comprising:

a mist chamber;

a fan operatively coupled to the mist chamber disposed above the top surface of the water level, the fan blows air into the mist chamber toward a top surface of the water level;

a floater slidably disposed within a float support, the floater having a bottom rim and a top rim;

a ultrasonic transducer disposed directly below the floater;

a tubular structure vertically disposed within the floater, the tubular structure having a widest diameter end disposed on the bottom rim and a narrower diameter end disposed at the top rim;

wherein the mist chamber diverts air of the humidifier and of the tubular structure; and wherein the top rim being operatively positioned a height below the water level of the humidifier, the height having a range between 5 mm and 20 mm.

12. The humidifier of claim 11, wherein a thickness of the floater is between a range of 15 mm to 20 mm.

13. The humidifier of claim 12, wherein the floater support is disposed on an outer surface of the floater and wherein the top rim is disposed at a height below the water level, the height being within a range of 5 mm to 20 mm.

14. The humidifier of claim 12, comprising a column disposed vertically and having a series of repeating through openings along its exterior walls.

15. The humidifier of claim 14, comprising an air diverting plate, and an intermediate chamber, the intermediate chamber receives the air from the air diverting plate from the fan before the mist chamber and is disposed above the top surface of the water level; wherein the intermediate chamber is an air supply channel that is disposed isolated from the mist chamber, the water level, and the column such that accidental tipping and water spillage from the tank is prevented from contacting electrical and mechanical portions of the fan.

16. The humidifier of claim 12, wherein the tubular structure includes a slanted directional frusto-conical shape with respect to a centrally located vertical axis of the tubular structure.

17. The humidifier of claim 12, wherein the floater has a diameter of the bottom rim with a range of 7 mm to 10 mm and a diameter of the top rim within a range of 4 mm to 6 mm.

18. A ultrasonic humidifier including a tank having a water level, the ultrasonic humidifier comprising:

a column disposed vertically and having a series of repeating through openings along its exterior walls, a floater, the floater having a bottom rim and a top rim; and a tubular structure vertically disposed within the floater, the tubular structure having a widest diameter end disposed on the bottom rim and a narrower diameter end disposed at the top rim;

wherein the column is operatively coupled with the floater and the column has a series of repeated through openings; and wherein the top rim of the floater operatively maintains a position at a height below the water level, the height within a lower range between 5 mm to 20 mm.

19. The humidifier of claim 18, wherein a thickness of the floater is between a range of 15 mm to 20 mm.

20. The humidifier of claim 18, comprising a fan operatively coupled to a mist chamber disposed above the top surface of the water level, the fan supplies air into the mist chamber toward a top surface of the water level; wherein the fan is disposed in an intermediate chamber and having an air vent that is a height within a range of 5 to 10 mm above the mist chamber, the water level, and the column such that accidental tipping and spillage from the tank is prevented from contacting electrical and mechanical portions of the fan.

* * * * *